US007823578B2

(12) United States Patent
Ruppel et al.

(10) Patent No.: US 7,823,578 B2
(45) Date of Patent: Nov. 2, 2010

(54) HIGH EFFICIENCY BIOMASS STOVE

(75) Inventors: Robert J. Ruppel, Cumberland, WI (US); Michael Avery, Cumberland, WI (US); David P. Flesch, Cumberland, WI (US); David E. Hare, Cumberland, WI (US); David J. Lynch, Cumberland, WI (US); Scott R. Nickell, Cumberland, WI (US)

(73) Assignee: Ardisam, Inc., Cumberland, WI (US)

( * ) Notice: Subject to any disclaimer, the term of this patent is extended or adjusted under 35 U.S.C. 154(b) by 35 days.

(21) Appl. No.: 12/019,277

(22) Filed: Jan. 24, 2008

(65) Prior Publication Data

US 2008/0173297 A1 Jul. 24, 2008

Related U.S. Application Data

(60) Provisional application No. 60/897,108, filed on Jan. 24, 2007.

(51) Int. Cl.
*F24B 7/00* (2006.01)
*F24B 7/04* (2006.01)

(52) U.S. Cl. ..... 126/72; 126/77; 126/146; 110/341

(58) Field of Classification Search ..... 110/267, 110/105, 293, 294, 110, 108, 314, 102, 347; 126/99 R, 99 A, 110 R, 109, 285, 66, 61, 126/67, 69, 72
See application file for complete search history.

(56) References Cited

U.S. PATENT DOCUMENTS 2,073,424 A * 3/1937 La Fay ..... 126/106
2,291,232 A * 7/1942 Juby, Jr. ..... 126/109
2,568,487 A * 9/1951 Carswell ..... 126/110 R
4,201,187 A * 5/1980 Skow ..... 126/110 E
4,214,569 A * 7/1980 Heine ..... 126/77
4,438,756 A * 3/1984 Chamberlain et al. ..... 126/522
4,449,510 A * 5/1984 Sukup ..... 126/99 A
4,545,360 A * 10/1985 Smith et al. ..... 126/76
4,559,882 A 12/1985 Dobson
4,579,102 A * 4/1986 Sukup ..... 126/99 A
4,730,597 A 3/1988 Hattenroth et al.
4,922,889 A * 5/1990 Nuesmeyer et al. ..... 126/73
5,144,941 A * 9/1992 Saito et al. ..... 126/507
5,611,331 A * 3/1997 Phillips ..... 126/539
5,678,494 A 10/1997 Ulrich
5,873,356 A * 2/1999 Vossler et al. ..... 126/110 E
6,463,926 B1 * 10/2002 Flick et al. ..... 126/512
7,004,084 B1 2/2006 Anderson et al.

(Continued)

FOREIGN PATENT DOCUMENTS

EP 1 734 303 A2 * 12/2006

*Primary Examiner*—Steven B McAllister
*Assistant Examiner*—Desmond Peyton
(74) *Attorney, Agent, or Firm*—Stoel Rives LLP

(57) ABSTRACT

A biomass stove includes a housing enclosing a firebox that defines a ceiling portion opposite a bottom, a firepot disposed within the firebox, an air intake assembly coupled to the firebox, and at least one duct disposed entirely inside the firebox and extending between the ceiling portion of the firebox and the air intake assembly. The duct(s) provide a heat exchanging flow path for ambient air entering the air intake assembly, where the ambient air is heated within the duct(s) prior to exiting through the ceiling portion of the biomass stove.

6 Claims, 4 Drawing Sheets

U.S. PATENT DOCUMENTS 7,318,431 B1 * 1/2008 Holtan et al. ..... 126/7
7,393,206 B2 * 7/2008 Lin ..... 432/219
7,422,429 B2 * 9/2008 Lin ..... 432/219
2004/0200394 A1 * 10/2004 Krumrei ..... 110/347
2007/0137537 A1 * 6/2007 Drisdelle et al. ..... 110/297
2007/0204845 A1 * 9/2007 Pleau ..... 126/77
2008/0173297 A1 * 7/2008 Ruppel et al. ..... 126/77

* cited by examiner

HIGH EFFICIENCY BIOMASS STOVE

CROSS-REFERENCE TO RELATED APPLICATIONS

This application claims the benefit under 35 U.S.C. §119 (e) of U.S. Provisional Application Ser. No. 60/897,108, filed Jan. 24, 2007.

FIELD

This application relates to air-to-air heat exchanging stoves such as parlor stoves and/or home heating stoves that burn solid fuel to generate heat that is directed into the room in which the stove is maintained.

BACKGROUND

Increasing fuel costs have encouraged consumers to consider alternative forms of energy production for heating their homes and offices. A biomass stove is one example of a popular option for heating homes and offices. Biomass stoves combust corn, wood pellets, or other solid fuels to generate heat energy. Increased use of biomass stoves has resulted in a desire to more efficiently convert the solid biomass fuels into useable heat energy.

Known biomass stoves include a biomass-fueled furnace as described in U.S. Pat. No. 4,559,882; a biomass stove as described in U.S. Pat. No. 4,730,597; a biomass-fueled furnace as described in U.S. Pat. No. 5,678,494; and a corn burner as described in U.S. Pat. No. 7,004,084. In general, the known biomass stoves potentially have one or more undesirable inefficiencies, including low overall efficiency, low burn efficiency, or cumbersome fuel changes.

For these and other reasons, there is a need for the present invention.

SUMMARY

One aspect provides a biomass stove including a firebox that defines a ceiling portion opposite a bottom, a firepot disposed within the firebox, an air intake assembly coupled to the firebox, and at least one duct disposed entirely inside the firebox and extending between the ceiling portion of the firebox and the air intake assembly. The duct(s) provide a heat exchanging flow path for ambient air entering the air intake assembly, where the ambient air is heated within the duct(s) prior to exiting through the ceiling portion of the biomass stove.

Another aspect provides a biomass stove including a housing maintaining a firebox that defines a ceiling portion opposite a bottom, a firepot disposed within the firebox, an air intake assembly coupled to the firebox adjacent to the bottom, and a first plurality of tubes disposed within and adjacent to a first lateral side of the firebox and a second plurality of tubes disposed within and adjacent to a second lateral side of the firebox. The first and second plurality of tubes extends between the ceiling portion of the firebox and the air intake assembly.

Another aspect provides a method of increasing combustion efficiency in a biomass stove. The method includes disposing a firepot within a firebox of the biomass stove, the firepot configured to burn solid biomass fuel, and disposing at least one duct entirely inside the firebox, the at least one duct extending between a first end disposed adjacent to a bottom of the firebox and a second end disposed at a ceiling portion. The method additionally includes flowing ambient air into the first end of the at least one duct, and transferring heat to the ambient air flowing in the at least one duct.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION

Figure 1B:
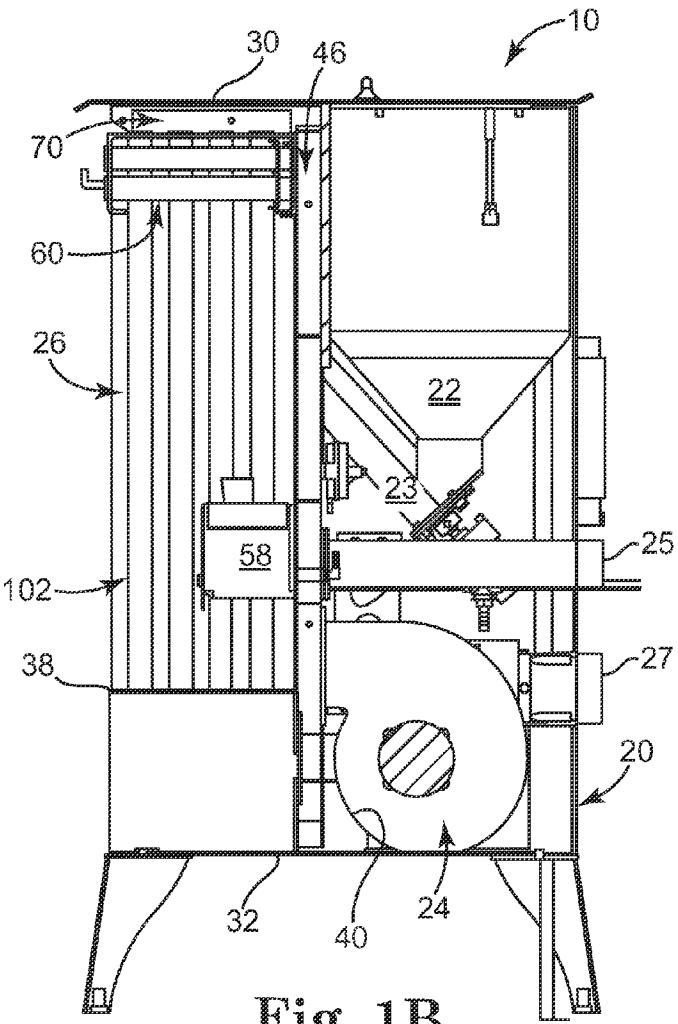
FIG. 1A is a front view and FIG. 1B is a cross-sectional view of a biomass stove according to one embodiment.

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

It is to be understood that the features of the various exemplary embodiments described herein may be combined with each other, unless specifically noted otherwise.

Embodiments provide a biomass stove having increased overall efficiency and increased burn efficiency as compared to conventional stoves. Embodiments provide improved efficiency characterized by increased heat output through the biomass stove with a lower exhaust temperature exiting the biomass stove.

Embodiments provide at least one heat exchanging duct that enables the biomass stove to be 10-40% more efficient than conventional stoves. The improved biomass stove provides increased heat exchange area and enables higher volumes of air to flow across the heat exchanging duct(s). Some embodiments provide for an increase in the dwell time of air flowing through the biomass stove, which results in improved heat transfer between the stove and the air that is eventually vented to the surrounding environment.

In one embodiment, a single duct is employed as an air-to-air heat exchanger. Ambient air drawn into the firebox flows through the single duct and is progressively heated as the air flows toward a ceiling portion of the firebox. The flow path is exposed to an increased heat exchange area within the firebox, which results in improved heat transfer from the heat source of the biomass stove to the air that is eventually vented into the stove's surroundings.

In another embodiment, the single duct is replaced with a plurality of tubes disposed within the firebox adjacent to at least one lateral wall of the biomass stove. The multiple tubes provide increased surface area for air-to-air heat exchange, which combines to increase the heat transfer from the heat generated by the firepot to the air brought into the stove.

In this specification, a biomass stove is defined to be an air-to-air heat exchanging solid-fuel burning stove. Air-to-air heat exchanging stoves include parlor stoves and/or home heating stoves configured to burn pellets such as wood pellets, corn, kernels of corn, corn cobs, other solid fuel, or other forms of biomass fuel to generate heat that is transferred to an air stream directed into the room in which the stove is maintained.

Figure 1A:
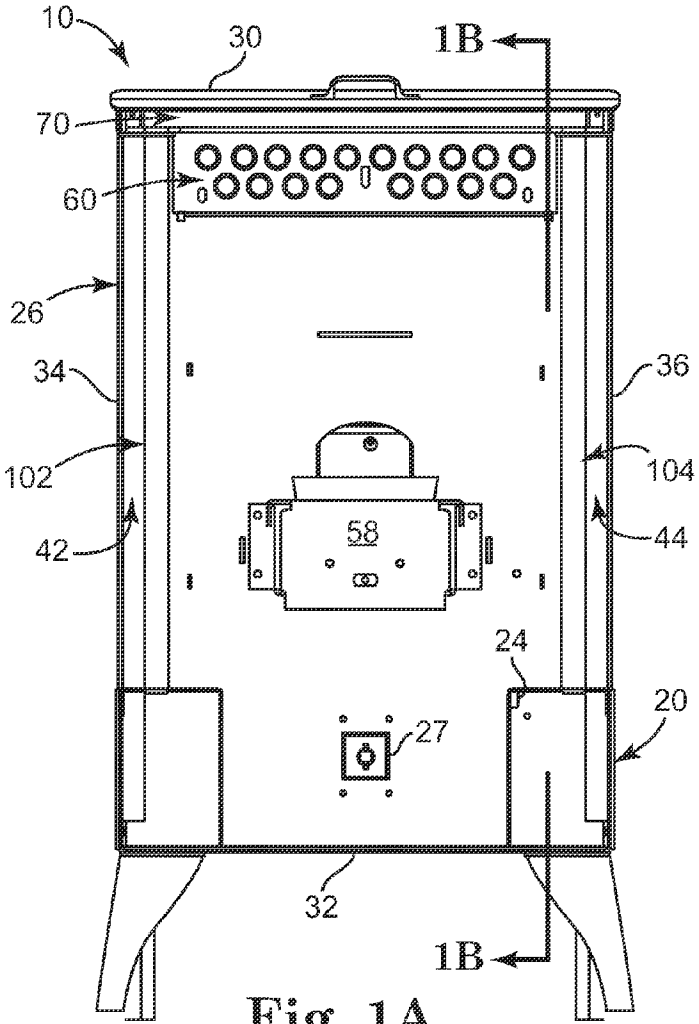

FIG. 1A is a front view and FIG. 1B is a cross-sectional view of a biomass stove 10 according to one embodiment. Biomass stove 10 includes a housing 20 maintaining a firebox 26, a hopper 22 and an auger 23 that feeds fuel pellets to a firepot 58, a combustion intake 25 for feeding oxygen to firepot 58, an exhaust 27 for exhausting all combustion gases generated by firepot 58 from stove 10, and an air intake assembly 24 that is configured to drive air-to-air heat exchange with firebox 26. Hopper 22 and auger 23 communicate with firebox 26 and firepot 58 resides in firebox 26 that sits on housing 20.

In one embodiment, stove 10 includes a top 30 disposed opposite a base 32, and a front 38 that includes a door (not shown) for accessing firebox 26, and firebox 26 includes lateral sides 34 and 36 extending between top 30 and base 32. In general, firebox 26 is maintained adjacent to front 38 of stove 10.

Hopper 22 and auger 23 include any suitable solid fuel pellet feed system as known in the art. In one embodiment, hopper 22 has a capacity of about 62 pounds of solid fuel pellets and auger 23 is selected to feed the pellets at a rate between about 1.5 to 5.2 pounds per hour. Other feeding systems are also acceptable.

Combustion intake 25 includes any suitable duct for delivering air (i.e., oxygen) to firepot 58. In one embodiment, combustion intake 25 is provided by a 2.0 inch round duct, although other sizes and configurations of ducts are also acceptable.

Exhaust 27 includes any suitable duct configured for drawing combustion gases away from firepot 58 and out of stove 10 (and out of the room that stove 10 is placed into). In one embodiment, exhaust 27 includes a 3.0 inch round exhaust duct, although other sizes and configurations (such as square-to-round) for ducts are also acceptable. In one embodiment, combustion gases are vented through exhaust 27 by a 56 Watt exhaust fan, although other sizes of exhaust fans are also acceptable.

Air intake assembly 24 includes a blower 40 that provides air flow through stove 10 for air-to-air heat exchange. For example, in one embodiment firebox 26 rests on housing 20. Firebox 26 integrally forms opposing side air ducts 42, 44, a back air duct 46, and a plenum 70 that cooperate with other ("in-situ") air-to-air heat exchanging plenum 60/ducts 102, 104 provided within firebox 26 to increase the heat exchange area of stove 10. Hot exhaust gases are drawn away from firepot 58, down the side air ducts 42, 44, and out of exhaust 27. Blower 40 draws air from the room and provides a positive pressure for air flow through back air duct 46 in addition to an upward flow of air through one or more separate ducts (68 in FIG. 2 and 102/104 in FIG. 1A) disposed within firebox 26. Heat is ultimately forced out of plenums 60 and 70. The separate ducts 68, 102/104 disposed within firebox 26 are exposed to a 360 degree circumferential heat exchange that provides stove 10 with an increased air-to-air heat exchanging area, which increases the amount of usable heat generated by stove 10 that is projected into the room.

In one embodiment, air intake assembly 24 includes a 220 Watt convection blower 40 that blows air upward through back air duct 46 and the separate ducts (68 in FIG. 2 and 102/104 in FIG. 3) disposed within firebox 26, thus creating a positive pressure that forces hot air out of plenums 60, 70.

A controller is electrically coupled to stove 10 and employed to control fuel metering, the convection blower, and to maintain heat control set points for stove 10. One suitable controller is the Tri-X™ Heat Control controller available from Cumberland Stove Works, Cumberland, Wis.

The combustion of the fuel provides heat that rises naturally before being forced out into the room, and the components of firebox 26, described below, are configured to increase overall air-to-air heat exchange efficiency and burn efficiency for biomass stove 10 in comparison to conventional stoves.

Figure 2:
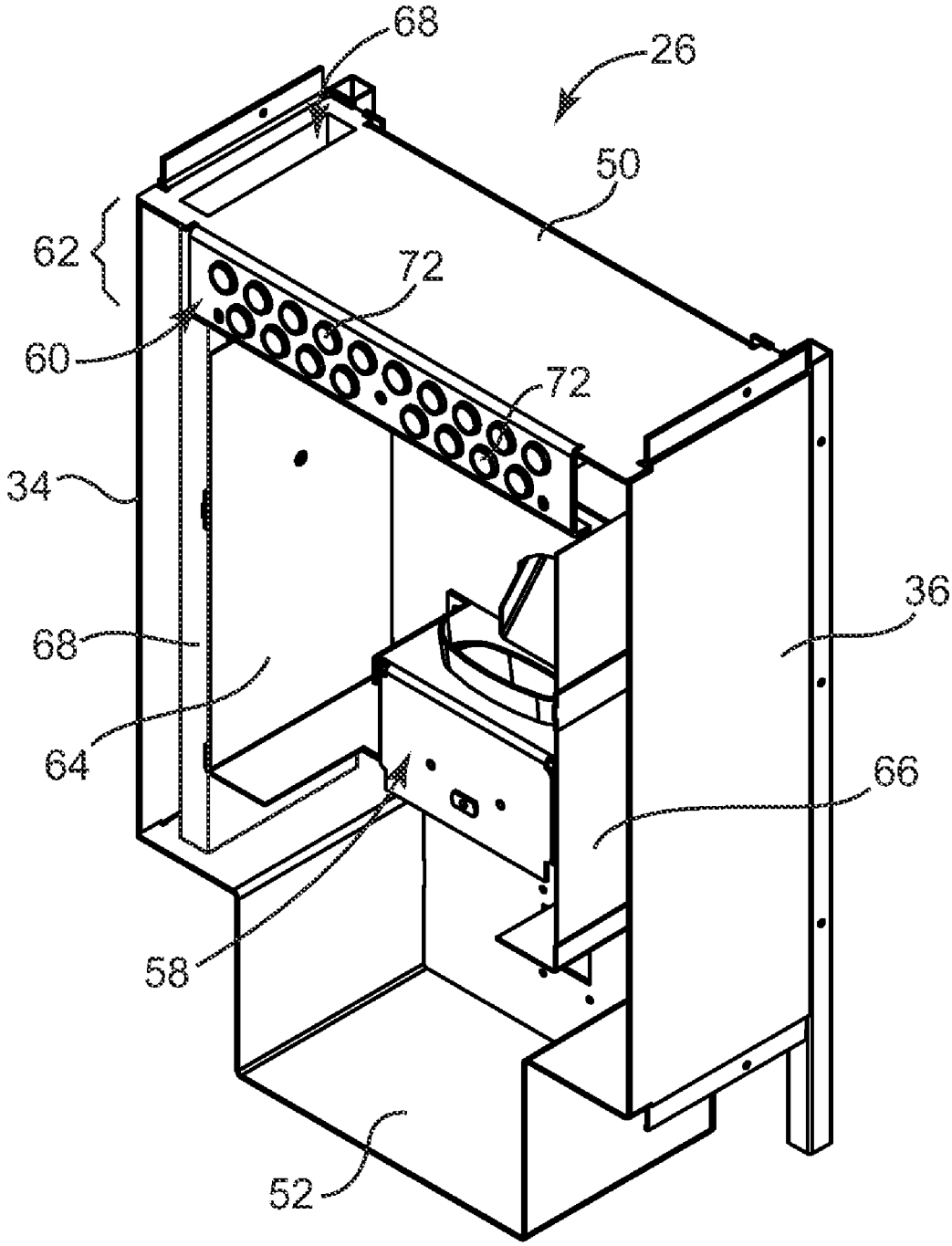
FIG. 2 is a perspective view of a firebox for the biomass stove according to one embodiment.

FIG. 2 is a perspective view of firebox 26 including a single duct 68 according to one embodiment. In this embodiment, firebox 26 includes a roof 50 opposite a bottom 52, the firepot 58 disposed between roof 50 and bottom 52, the first plenum 60 disposed within a ceiling portion 62, a first baffle 64 opposite a second baffle 66, and one duct 68 that extends between and is in fluid communication with ceiling portion 62 and air intake assembly 24 (FIG. 1B). Duct 68 is disposed entirely inside firebox 26 and is disposed adjacent to lateral side 34.

In one embodiment, and with additional reference to FIGS. 1A/1B, when firebox 26 is placed on housing 20, bottom 52 sits on base 32 and roof 50 is spaced apart from top 30 of stove 10 to define a spacing 70 or a second plenum 70. Plenum 60 is configured to convect the heat that rises naturally from firepot 58 outward from a plurality of horizontal tubes 72. Plenum 70 resides above plenum 60 and is configured to collect the heated air driven by the blower 40 through the separate duct 68 or tubes 102/104 before directing the collected heat out of the front of stove 10.

First baffle 64 and second baffle 66 are disposed on either side of firepot 58 and are configured to constrain the lateral flow of heat generated by firepot 58. In one embodiment, first baffle 64 is disposed between duct 68 and firepot 58 and second baffle 66 is disposed between side 36 and firepot 58.

In one embodiment, duct 68 is a rectangular duct formed of metal that is sealed at the bottom and top ends to separate the convective air flow inside duct 68 from combustion gases on the outside of duct 68. Air flowing upward through duct 68 is eventually vented out of stove 10 through plenum 70 (FIGS. 1A/1B).

During use, heat generated by firepot 58 rises toward roof 50, passes between horizontal tubes 72, and is directed into the room via plenum 60. In addition, air intake assembly 24 (FIG. 1B) forces ambient air along the length of duct 68, from a location adjacent to bottom 52 upwards toward ceiling portion 62. The ambient air forced up the duct 68 is heated and ultimately ejected out of plenum 70. Hot combustion gases from firepot 58 are drawn down along both sides of duct 68 and vented out of exhaust 27. In this manner, an entirety of the inside and outside of duct 68 provides air-to-air heat exchanging area for stove 10. In other words, the entire duct 68 is in fluid communication with the ambient air pushed in by air intake assembly 24 and exhaust drawn through exhaust 27, thus forming a "360 degree" heat exchanger within firebox 26.

Figure 3:
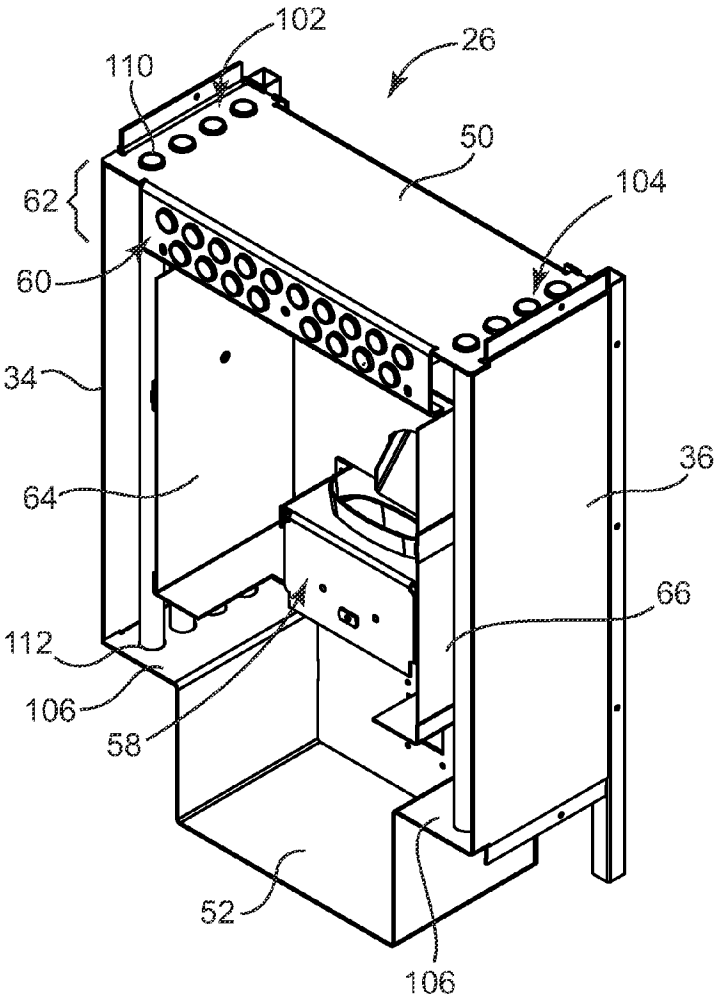
FIG. 3 is a perspective view of a firebox for the biomass stove as shown in FIG. 1B according to one embodiment.

FIG. 3 is a perspective view of firebox 26 according to another embodiment. Firebox 26 includes roof 50 opposite bottom 52, opposing sides 34, 36, firepot 58 disposed between roof 50 and bottom 52, plenum 60 disposed within ceiling portion 62, first and second baffles 64, 66 disposed on either side of firepot 58, and multiple heat transfer ducts formed from a first plurality of tubes 102 and a second plurality of tubes 104. Tubes 102, 104 include various geometric shapes other than cylindrical pipes and are generally disposed adjacent to lateral sides 34, 36 of firebox 26.

In one embodiment, first and second plurality of tubes 102, 104 define heat exchangers that include hollow circular cylinders extending between roof 50 and a shoulder 106. Other geometric shapes for tubes 102, 104 are also acceptable. In one embodiment, the tubes 102, 104 include a first end 110 opposite a second end 112, where first end 110 projects into an exit opening of roof 50 and second end 112 projects through shoulder 106. Shoulder 106 is disposed adjacent to air intake assembly 24 (FIG. 1). In other embodiments, the tubes 102, 104 include a first end 110 opposite a second end 112, where first end 110 of tubes 102, 104 project into an exit opening provided anywhere around a circumference of stove 10 between top 30 and base 32 and second end 112 projects through shoulder 106.

First ends 110 of tubes 102, 104 are sealed and coupled to roof 50 and second ends 112 of tubes 102, 104 are sealed and coupled to shoulder 106. Tubes 102, 104 are suitably secured to roof 50 and shoulder 106 by, for example, welding, brazing, soldering, fasteners, press-fit attachment, etc. Ambient air brought into firebox 26 is heated as it flows up tubes 102, 104, ultimately mixing with heat rising from firepot 58, and both heated streams are ejected through their respective plenums 70 and 60 into the room.

In one embodiment, the tubes 102, 104 include one or more tubes disposed between side 34 and baffle 64 and one or more tubes disposed between side 36 and baffle 66. The exemplary embodiment of FIG. 3 illustrates four tubes 102 and four tubes 104 disposed on a perimeter for firebox 26 in a manner that provides an eight tube vertical air-to-air heat exchanger. It is to be understood that the plurality of tubes 102, 104 can include as few as one tube (similar to duct 68 in FIG. 2) or two or more tubes disposed adjacent to at least one side of firebox 26.

Figure 4:
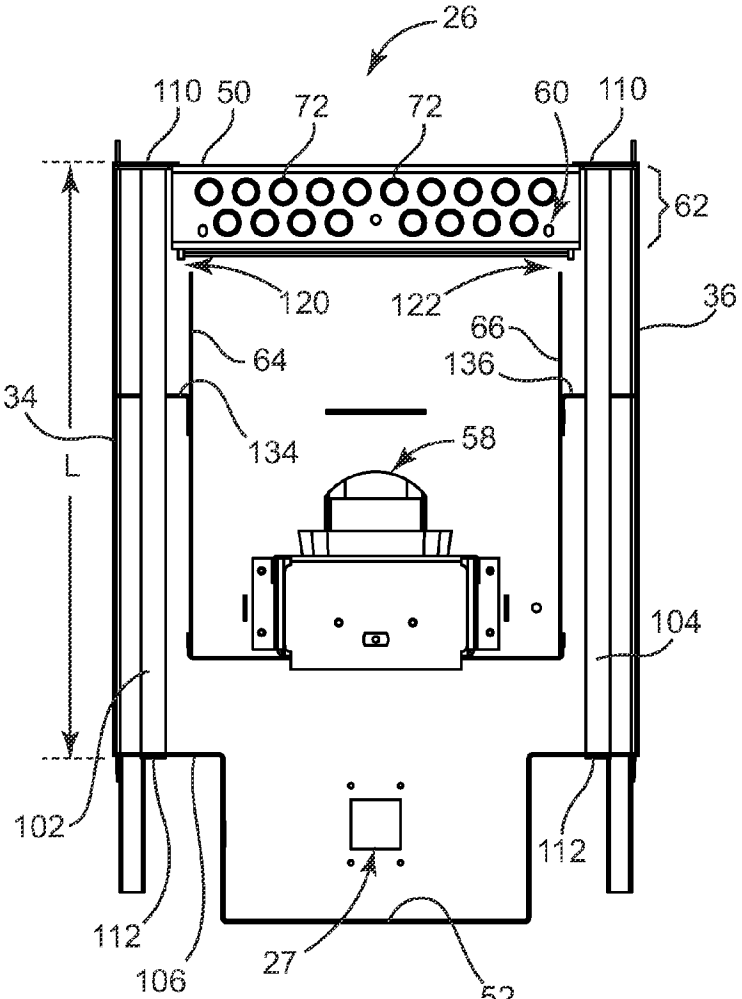
FIG. 4 is a front view of the firebox shown in FIG. 3.

FIG. 4 is a front view of firebox 26. Heat exchanging tubes 102, 104 are disposed within firebox 26 adjacent to sides 34, 36, respectively. In one embodiment, tubes 102 are open on ends 110, 112, extend between roof 50 and shoulder 106, and are spaced between side 34 and baffle 64. Tubes 104 are likewise open on ends 110, 112, extend between roof 50 and shoulder 106, and are spaced between side 36 and baffle 66. Ends 110 terminate through roof 50 and thus communicate with plenum 70 (FIG. 1A) and ends 112 are in fluid communication with the air flow generated by blower 40 (FIG. 1B).

In one embodiment, each of the tubes 102, 104 is formed from a metal or other material having suitably high heat conduction and includes, as an example, an inside diameter of between about 0.75-2.0 inches and a length L of between about 1-3 feet. Other forms of tubes 102, 104 are also acceptable, including tubes having rectangular cross-sections, tubes having multi-faceted sides/faces, accordion "pleated" tubes and the like. In one embodiment, biomass stove 10 (FIG. 1A) is a parlor stove that provides about 45,000 BTU/Hr with a heating capacity of about 1200 square feet, and tubes 102, 104 are sized to provide an increased heat transfer area configured to improve the overall heat efficiency of stove 10. Other suitable sizes for tubes 102, 104 are also acceptable based upon a desired heating capacity for stove 10.

A gap 120 is provided between baffle 64 and plenum 60, and a separate gap 122 is provided between baffle 66 and plenum 60. Gaps 120, 122 communicate with an exterior surface of tubes 102, 104 and the space between sides 34, 36 and baffles 64, 66. In one embodiment, gaps 120, 122 are selectively sized to constrain or otherwise meter the flow of hot combustion gases leaving firepot 58 that are permitted to contact the exterior of tubes 102, 104. In one exemplary embodiment, gaps 120, 122 are sized to be between about 0.25-2.0 inches.

In one embodiment, switchback plates 134 and 136 are provided to adjust the convective flow across the exterior of tubes 102, 104. In one embodiment, switchback plate 134 spans between side 34 and baffle 64 and is configured to selectively adjusted dwell time of the convective flow across tubes 102. In a similar manner, switchback plate 136 extends between side 36 and baffle 66 to selectively adjust dwell time of the convective flow across tubes 104.

Figure 5:
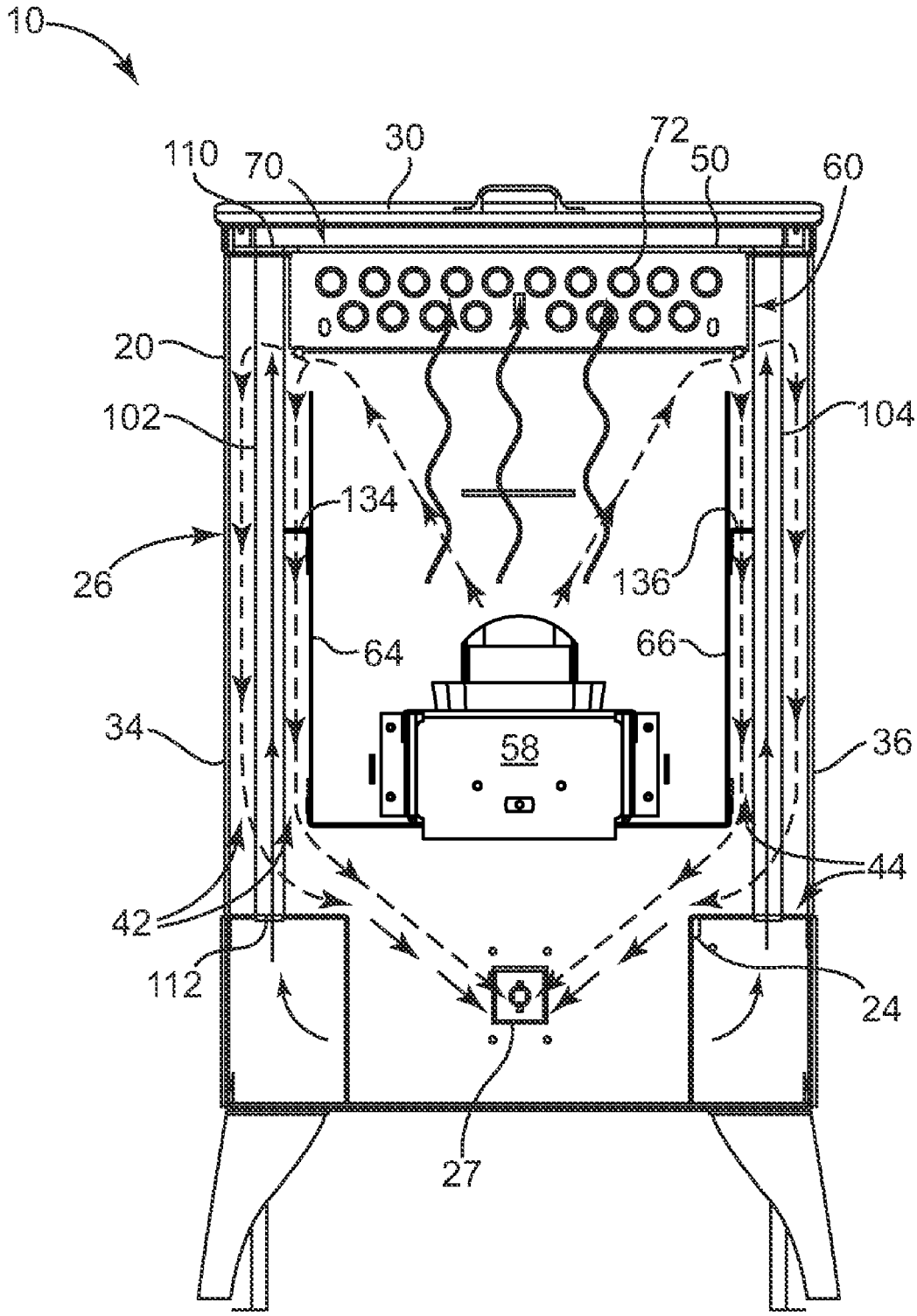
FIG. 5 is a schematic view of the firebox shown in FIG. 4 showing exemplary air-to-air heat exchanging flow paths according to one embodiment.

FIG. 5 is a cross-sectional view showing a schematic representation of heat exchange inside biomass stove 10. As described above, stove 10 is formed by the integral units of the firebox 26 that is inserted into the housing 20. Firebox 26 together with housing 20 combine to form the opposing side air ducts 42, 44, a back air duct 46 (FIG. 1B), and a plenum 70 that cooperate with the in-situ air-to-air heat exchanging plenum 60 and ducts 102, 104 provided within firebox 26.

During use, firepot 58 combusts solid fuel pellets to create heat. Heat from firepot 58 rises naturally toward roof 50 of firebox 26 and is vented out of plenum 60. Combustion gases from firepot 58 rise up and pass through gaps 120, 122 (FIG. 4), flow outward around tubes 102, 104, and are eventually pulled downward and to the mid-section of stove 10 before being exhausted through exhaust 27. The dwell time of the combustion gases flowing across tubes 102, 104 can be increased by switchback plates 134, 136, respectively. The heated combustion gases thus transfer heat to the exterior surfaces of the vertical heat exchanging tubes 102, 104.

In addition, air intake assembly 24 forces ambient air upward through back air duct 46 (FIG. 1B) and upward into tubes 102, 104. The flow of the air is directed along tubes 102, 104 from end 112 toward end 110 and into spacing 70 or plenum 70. The air flow inside tubes 102, 104 is heated as heat energy is extracted from the hot combustion gases on the outside of tubes 102, 104. The heated air inside tubes 102, 104 is heated as it flows upward, eventually reaching plenum 70 and being ejected into the room.

The hot gases that convectively flow across the exterior of tubes 102, 104, incrementally increases the heat transferred to the ambient air passing through tubes 102, 104. In this manner, the volume of air that flows across tubes 102, 104 is increased and the air that flows within tubes 102, 104 is also increased. Tubes 102, 104 thus provide an increase in the heat exchange area, which leads directly to an increase in the heat provided to the room. As a consequence, biomass stove 10 is 10-40% more efficient than conventional biomass stoves.

The air flowing through tubes 102, 104 is exposed to an entire 360 degree heat exchanger formed by tubes 102, 104, thus providing an increase in heat exchange area, which increases the total amount of heat exchanged. The increased area and flow path for the air pulled through and across tubes 102, 104 efficiently extracts heat from the combustion process, which produces more heat per pound of fuel. The heat that is generated an efficiently harnessed by stove 10 is ultimately vented into the room in which stove 10 resides.

In one embodiment, biomass stove 10 is configured to convert over 99% of the solid fuel burned by firepot 58 into useable heat energy. In contrast, conventional biomass stoves convert less than about 97% of the fuel that they burn into useable heat energy and produce 2-3 times as much ash as biomass stove 10. Embodiments of biomass stove 10 provide a stove that provides about 80% useable heat (measured as BTU useable per BTU input).

In one embodiment, biomass stove 10 is configured for air-to-air heat transfer even if blower 40 (FIG. 1B) is not operating. For example, it has been surprisingly discovered that the free convective flow of the rising hot combustion gases from firepot 58 that are ultimately drawn out of exhaust 27 will continue to drive the air-to-air heat transfer even if blower 40 is not operational.

The overall efficiency of biomass stove 10 is greater than the efficiency of conventional biomass stoves. For example, the exhaust temperature for the exhaust vented through exhaust 27 is less than about 300 degrees Fahrenheit. In one exemplary embodiment, the exhaust vented through exhaust 27 is about 250 degrees Fahrenheit for biomass stove 10. Conventional stoves have an exhaust temperature that is greater than 300 degrees Fahrenheit and in some cases as much as 600 degrees Fahrenheit.

Embodiments provide a firebox that is configured to efficiently harness rising warm air, provide an increasing heat change area that increases heat exchange through the biomass stove, and provides an increase in the volume of air flow across the air-to-air heat exchangers. Consequently, biomass stove is configured to provide higher overall stove efficiency with higher burn efficiency.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of fireboxes for biomass stoves as discussed herein. Therefore, it is intended that this invention be limited only by the claims and the equivalents thereof.

What is claimed is:

1. A biomass stove comprising:

a firebox having a ceiling portion opposite a bottom, a rear side opposite a front, and first and second opposing lateral sides which extend vertically between the bottom and the ceiling portion and from the front to the rear side;

a firepot disposed within the firebox between the first and second lateral sides on the rear side between the bottom and the ceiling portion;

a first plenum formed between the ceiling portion and a top side of a housing enclosing the firebox;

an air intake assembly coupled along the bottom of the firebox; and at least one duct comprising a first plurality and a second plurality of tubes disposed within the firebox and extending vertically between the air intake assembly along the bottom of the firebox and the first plenum, the first plurality of tubes being spaced apart from one another and disposed along, but spaced from, the first lateral side between the front and rear side and positioned between the firepot and the first lateral side so as not to come between the firepot and the front of the firebox, and the second plurality of tubes being spaced apart from one another and disposed along, but spaced from, the second lateral side between the front and rear side and positioned between the firepot and the second lateral side so as not to come between the firepot and the front of the firebox;

wherein the first plurality and second plurality of tubes provide a heat exchanging flow path for ambient air entering the at least one duct from an exterior environment via the air intake assembly and exiting through the first plenum to the exterior environment, wherein the ambient air is heated by heated gas produced by the firepot within the firebox as the ambient air passes through the first plurality and second plurality of tubes;

a first vertical baffle disposed between the first plurality of tubes and the firepot and forming a first heat exchange duct with the first lateral side and a second vertical baffle disposed between the second plurality of tubes and the firepot and forming a second heat exchange duct with the second lateral side, the first and second vertical baffles having upper edges spaced from the ceiling portion so as to form corresponding cross-flow openings between the ceiling portion the upper edges of the first and second vertical baffles;

a horizontal baffle extending between lower edges of the first and second vertical baffles so as to form an exhaust chamber between the horizontal baffle and the bottom of the firebox and a combustion chamber between the horizontal baffle and ceiling portion in which the firepot is positioned; and an exhaust configured to draw heated gas from the combustion chamber through the first and second heat exchange ducts via the corresponding cross-flow openings and into the exhaust chamber where the heated gas is vented from the biomass stove, wherein the heated gas heats the ambient air in the first and second pluralities of tubes as the heated gas flows through the first and second heat exchange ducts.

2. The biomass stove claim 1, wherein an entirety of an external surface area of the tubes of the first plurality and second plurality of tubes are exposed to an interior of the firebox.

3. The biomass stove of claim 1, further comprising:

a first switchback plate positioned between the first vertical baffle and first lateral side and a second switchback plate positioned between the second vertical baffle and second lateral side, the first and second switchback plates configured to increase a dwell time of heated gas from the firepot flowing across the first plurality and second plurality of tubes.

4. The biomass stove of claim 1, wherein the ceiling portion comprises a second plenum comprising a third plurality of tubes positioned horizontally from the front to the rear side, wherein a first end of each of the tubes is open to the exterior environment and a second end of each of the tubes is in communication with a rear duct extending vertically along the rear side of the firebox from the air intake assembly which provides a flow of ambient air to the third plurality of tubes, wherein the ambient air is conductively heated by the heated gas within the firebox as the ambient air passes through the tubes to the exterior environment.

5. A biomass stove comprising:

a housing maintaining a firebox, the firebox having a ceiling portion opposite a bottom, a front and a rear side, and first and second opposing lateral sides, wherein a plenum is formed between the ceiling portion and a top of the housing;

a firepot disposed within the firebox;

an air intake assembly along the bottom of the firebox; and a first plurality of tubes disposed adjacent to and along the first lateral side between the front to the rear side and a second plurality of tubes disposed adjacent to and along the second lateral side between the front and rear side, the first and second plurality of tubes extending vertically between the air intake assembly and the plenum, wherein the first plurality of tubes is positioned between firepot and the first lateral side and the second plurality of tubes is positioned between the firepot and the second lateral side so as to maintain a space within between the firepot and the front of firebox free of obstructions;

a first vertical baffle disposed between the first plurality of tubes and the firepot;

a second vertical baffle disposed between the second plurality of tubes and the firepot; and a horizontal baffle disposed between bottom edges of the first and second vertical baffles, wherein the first and second plurality of tubes communicate with and are sealed to an exit opening provided in the ceiling portion of the firebox to the plenum and communicate with and are sealed to the air intake assembly, and wherein an entire circumference of each of the first and second plurality of tubes is exposed to an interior of the firebox and defines an air-to-air heat exchanger.

6. The biomass stove of claim 5, wherein each of the first and second plurality of tubes define an open top in fluid communication with a plenum disposed within the ceiling portion of the firebox and an open bottom in fluid communication with the air intake assembly.

* * * * *